US006843390B1

(12) United States Patent
Bristor

(10) Patent No.: US 6,843,390 B1
(45) Date of Patent: Jan. 18, 2005

(54) MULTIPLE FLUID CLOSED SYSTEM DISPENSING DEVICE

(76) Inventor: Joe G. Bristor, 23837 108$^{th}$ Ave. SE. #425, Kent, WA (US) 98031

( * ) Notice: Subject to any disclaimer, the term of this patent is extended or adjusted under 35 U.S.C. 154(b) by 0 days.

(21) Appl. No.: 10/389,873

(22) Filed: Mar. 17, 2003

(51) Int. Cl.$^{7}$ ..... B65B 1/04
(52) U.S. Cl. ..... 222/145.5; 222/383.1
(58) Field of Search ..... 222/145.1, 145.5, 222/145.6, 376, 382, 383.1, 383.3

(56) References Cited

U.S. PATENT DOCUMENTS

| | | | | |
|---|---|---|---|---|
| 4,355,739 A | | 10/1982 | Vierkotter | 222/134 |
| 4,826,048 A | | 5/1989 | Skorka et al. | 222/137 |
| 5,002,684 A | | 3/1991 | Beck et al. | 8/102 |
| 5,152,461 A | | 10/1992 | Proctor | 239/304 |
| 5,472,119 A | | 12/1995 | Park et al. | 222/145.8 |
| 5,492,540 A | | 2/1996 | Leifheit et al. | 8/111 |
| 5,767,055 A | | 6/1998 | Choy et al. | 510/406 |
| 5,857,591 A | * | 1/1999 | Bachand | 222/1 |

* cited by examiner

*Primary Examiner*—Steven O. Douglas

(57) ABSTRACT

A dispensing device (1) with multi-arm tubing assembly (10) connected to a single source pumping means (12) draws and mixes multiple fluids from plurality of flexible walled sealed supply containers (50*a,b*) then expels the mixture (60) through nozzle (58) to a target surface (62). Dispensing device (1) provides a closed system whereby no venting occurs, rather supply containers (50*a,b*) contract in size equal to the volume of fluid expelled. Unstable fluids thus remain protected from exposure to outside air. Additionally, a new use of a repressurization device is disclosed for maintaining the potency of unstable fluids like hydrogen peroxide and a kit is provided which allows user to choose from various components and accessories as needed to suit their multi-chemical dispensing needs.

8 Claims, 3 Drawing Sheets

58
12
11
10
20
22
28
28c
28a
28b
18a
18b
24a
24b
26a
26b
16a
16b
31a
32a
33a
30a
35a
14a
15
30b
31b
32b
33b
35b
14b
40b
42b
41b
45b
43b
42a
41a
45a
43a
40a
33
30
16
32
14
35
31
36
34

40
14
42
43
41
44

MULTIPLE FLUID CLOSED SYSTEM DISPENSING DEVICE

BACKGROUND OF THE INVENTION

1. Field of the Invention

This invention relates to the field of fluid dispensers and specifically to an improved dispensing device for containing multiple fluids in non-vented containers, mixing them and dispensing the mixture to stained textile fabrics, especially carpet.

2. Description of the Prior Art

Stains are a major reason why homeowners replace their carpet. Misinformation abounds regarding spot cleaning carpet, even though the rules remain the same: prompt treatment with the correct chemicals and procedures. Many a spot has become a permanent stain from neglect, and/or improper treatments and procedures. Store shelves overflow with spot cleaners that don't work; many of which if applied to carpeting, will void the Carpet Warranty.

Although many common stains from soils and oils can be removed with a simple mist & blot procedure, using dilute liquid hand dishwashing detergent solution, similar treatments are ineffective in removing organic dye type stains from coffee, tea, urine, wine, and artificial dyes like Red FD&C 40. Homeowners buy powdered "oxygen cleaners" and mix them with water then apply the solution to their dye type stains. These oxidation agents are only marginally effective on organic dyes, and only if they're applied with patience and persistence. The reactions are slow and short-lived. Novice spotters get impatient and mix too much powder relative to water. They reason, "if a little is good, a lot is better." Manufactures contribute to the problem by encouraging homeowners to "pour" the solution. Pouring any liquid onto a carpet is bad procedure, especially in the case of overly concentrated oxidizing agents. Pouring can cause permanent damage to fibers, backing, padding and underlying wooden sub floors. There is no reason for any of this damage. Professional carpet cleaners use more effective chemicals and procedures for treating dye type stains.

Professional cleaners prefer to use a mixture of Hydrogen peroxide plus an alkaline solution for treating organic dye type stains. The mixture, herein referred to as 'two-part oxidant' creates a short-lived reaction that goes to completion in about 30 minutes, so the two liquids must be kept separate until the time of use. Chemical manufacturers sell professional cleaners these and other two-part oxidant products to be mixed on the cleaning job. The two-part oxidant typically comes in sealed, paired pint containers with part A being hydrogen peroxide and part B being an ammonia or amine/surfactant solution. The procedure involves mixing roughly equal amounts of parts A & B in a measuring cup then inserting the dip tube of a trigger sprayer into the mixture and misting the stain. Several of these 'mix and mist' applications may be required to remove the dye type stains. It's guesswork estimating how much of the mixture will be needed for a given job. If the user mixes too much, it's wasted. If he doesn't mix enough, he must stop and measure more. And if the user accidentally leaves the cap to the hydrogen peroxide container slightly ajar, the hydrogen peroxide goes flat rendering the mixture ineffective. There has as yet been devised a means of extending the shelf-life of the unstable chemicals like hydrogen peroxide. Manufactures only sell their two-part products in the smaller sized containers. They know that larger containers would accumulate too much air over the unstable chemicals as they emptied which would allow them to go flat too fast. So pros go through a lot of these smaller pint sized bottles in their work. Once they are empty, they are discarded. Professional cleaners need a more efficient means of storing, mixing, and dispensing their two-part oxidizing agents.

Other specialty products are available to professionals for treating the more difficult to remove artificial dyes like Red FD&C 40. Some are two-part products which are mixed 50:50, misted onto the spot, then accelerated with the known heat transfer process. Others incorporate the known heat transfer process. Beck and Harris, U.S. Pat. No. 5,002,684 (1991) describes the use of 'moist heat' used in connection with his patented dye removal composition and method. But neglect and/or improper treatment can permanently set dye related stains such that even these specialty products are ineffective in removing these dye stains. As Beck and Harris state, " . . . more carpets are replaced because of stains which cannot be removed than from carpets being worn out."

Homeowners sometimes have an advantage over the pros; they are there when the spill occurs. If they just had the right chemicals and acted promptly with them, they would be successful in removing most of their dye related stains. Two-part oxidant products would remove their organic dye type stains and the specialty two-part products would help them with the artificial dyes so the heat transfer process would probably not even be necessary. But unfortunately, these two-part products are not available off-the-shelf. Regarding the two-part oxidant, homeowners would experience the same problems the pros have; they would discover their hydrogen peroxide had gone flat before it had been used up. They won't need it often but when they do, it won't perform.

Applicant has made an effort to utilize existing aerosol technology in providing a device to solve these dispensing problems. However, aerosolizing manufacturers are reluctant to develop an aerosol system that contains two-part oxidants in a single container because of the corrosive effect of the mixture on internal metal components. Even the bag & can system would expose the corrosive mixture to the internal metal actuator. Plus, such a design would be expensive to develop. Actually, there is no need for this expense since there are several trigger sprayer type multi-compartment dispensing devices that are capable of containing, mixing and dispensing two-part oxidants.

Various multi-compartment dispensing devices are known in the art which keep liquids separate until the time of mixing. Notable of these designs is U.S. Pat. No. 4,355,739, to Vierkotter (1982). For general purpose cleaners, this device would probably work fine. However, popular solvents like D-limonene might damage its specialized components. U.S. Pat. No. 4,826,048 to Skorka, et al. (1989) is another of these complex designs, featuring a bridge-like top cap with unique multiple piston-type discharge pumps. It would likely be costly to repair. This invention clearly demonstrates another problem with all rigid neck type dispensers: it is awkward to dispense fluids onto a horizontal surface. U.S. Pat. No. 5,152,461 to Proctor (1992) is another specialized and elaborate multi-compartment device. It retails for several times that of a conventional trigger sprayer ($30 on the Amway website). If one of its valves or many moving parts were to fail, the entire device would likely have to be replaced.

U.S. Pat. No. 5,472,119 to Park et al. (1995), teaches an ingenious multi-compartment dispenser that simultaneously vents and dispenses two fluids. They teach that "fluid drawn . . . must be replaced by air (venting) for pumping to continue else containers simply collapse." So, theirs replaces the fluid with fresh air every time the trigger is actuated (squeezed). But this venting is not a preferable way to contain unstable chemicals like hydrogen peroxide. Venting is like leaving the cap off the bottle. A closely related subsequent U.S. Pat. No. 5,492,540 to Leifheit, et al. (1996) addresses mixing incompatible chemicals. Leifheit, et al. correctly claim hydrogen peroxide to be a superior stain fighter yet they not only fail to address the problem caused by venting, but they are also silent on providing a means of solving the problem of gaseous pressure build-up inside the mixing chamber. U.S. Pat. No. 5,767,055 to Choy (1998) defines and offers solutions to the unexpected 'shooting' problem of earlier dispensers by means of minimizing the size of the mixing chamber or moving it beyond the nozzle. Yet, Choy's device suffers from some of the same problems as those previously mentioned, namely it uses specialized manufacturing which makes it expensive and hard to maintain, and the rigid neck which makes it awkward to mist onto horizontal surfaces. Choy mentions H2O2 as a suitable oxidizing agent yet even he is silent on sustaining its potency.

Anybody who has ever had their soda pop go 'flat' would appreciate a means of sustaining an unstable chemical's potency. There are inventive repressurizing devises available that prevent soda pop from going flat. U.S. Pat. No. 4,723,670 to Robinson (1988) discloses a device that "pressurizes a beverage container with ambient air" so the gas is forced to stay in solution. Some two part products don't require the use of unstable chemicals but in the case of the two part oxidant product, hydrogen peroxide is the oxidant of choice. Both the professional cleaner and the homeowner alike could benefit from a means of maintaining its potency so when a spill occurs, their two part oxidant mixture is effective.

BRIEF SUMMARY OF INVENTION

A new multi-compartment dispensing device is disclosed with a flexible tubing assembly that connects supply containers to single source pumping means for dispensing fluid mixtures, especially useful for removing dye related stains from textile fabrics with improved efficiency.

In accordance with the present invention, a dispensing device is provided that:

(i) gives homeowners more effective alternatives to aerosols and powders for removing dye related stains effectively without causing damage to fibers, fabrics and sub floors, (ii) adapts to manufacturers two part paired product containers and automatically mixes and dispenses mixtures at user defined dilution ratios, (iii) incorporates readily available components including containers, flow chambers, and pumping means that inexpensively satisfy the multi-fluid dispensing needs of the user and thus eliminate the need for specialized, more expensive components, (iv) lets the user easily mist a mixture onto horizontal surfaces without having to tilting the dispenser's supply containers. The dispenser also eliminates spilling, leakage, and wasting of fluids, (v) prevents shooting fluids or gases from the nozzle of dispensing device, (vi) maintains the potency of any unstable chemicals stored in supply containers and accessory stock containers so that they're still potent when needed, even after long periods of storage, and (vii) provide dispensing device in a customizable, versatile, and adaptive, kit form.

BRIEF DESCRIPTION OF THE DRAWINGS

The present invention may be more readily described by reference to the accompanying drawings, in which.

REFERENCE NUMERALS IN DRAWINGS

| | |
|---|---|
| Closed system dispensing device | 1 |
| Multi-arm tubing assembly | 10 |
| Pump inlet | 11 |
| Pumping means | 12 |
| Flow channels | 14a,b |
| Arrow | 15 |
| Flow channels | 16a,b |
| Flow channels | 18a,b |
| Flow channel | 20 |
| Flow switch | 22 |
| Flow switches | 24a,b |
| Check valves | 26a,b |
| Manifold | 28 |
| Inlet ports | 28a,b |
| Outlet port | 28c |
| Panel mount fitting assemblies | 30a,b |
| Male leur fittings | 31a,b |
| Locking nuts | 32a,b |
| Caps | 33a,b |
| O-ring | 34 |
| Female leur fittings | 35a,b |
| Male threads | 36 |
| Metering tip assemblies | 40a,b |
| Threaded inserts | 41a,b |
| Insert clamps | 42a,b |
| Metering tips | 43a,b |
| Orifice | 44 |
| Strainers | 45a,b |
| Supply containers | 50a,b |
| Supply container bases | 51a,b |
| Fluids | 53a,b |
| Nozzle | 58 |
| Mixture | 60 |
| Target surface | 62 |
| Dispenser pouch | 64 |
| Container restrainer | 66 |
| Extension handle | 68 |

DETAILED DESCRIPTION

Figure 1:
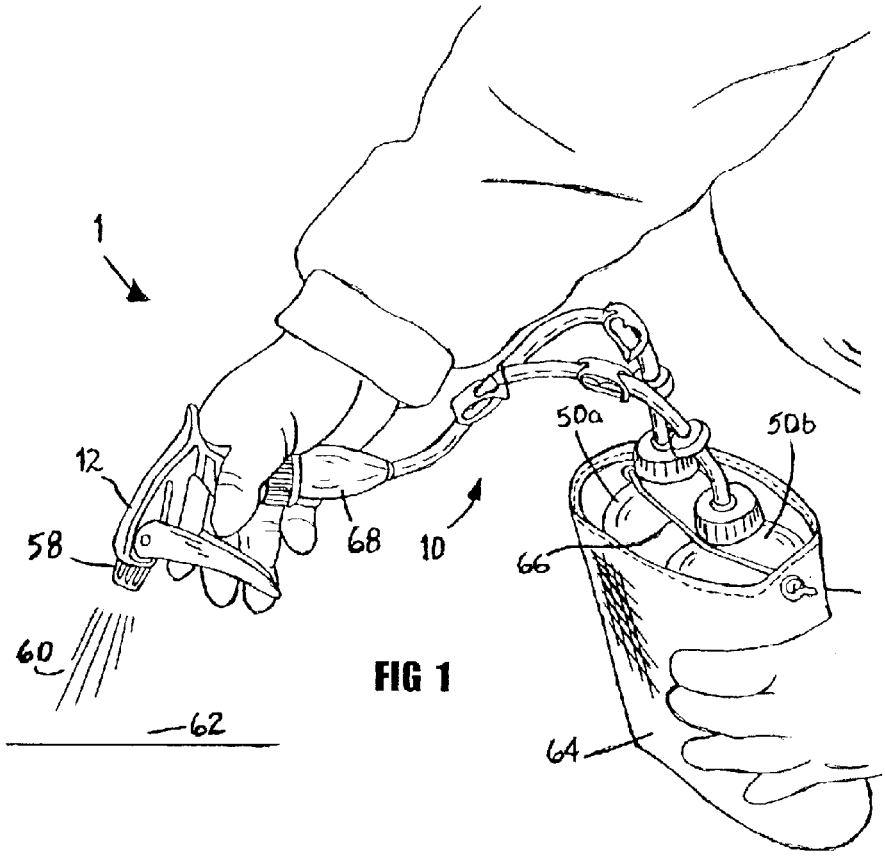
FIG. 1 is a perspective view of a user misting a horizontal surface.

Referring more particularly to the drawings by characters of reference, FIG. 1 discloses the preferred embodiment of the closed system dispensing device 1 of the present invention used for dispensing multiple fluids efficiently. Closed system dispensing device 1 comprises the main components of a multi-arm tubing assembly 10 in fluid communication with supply containers 50*a,b* and a pumping means 12.

Figure 2:
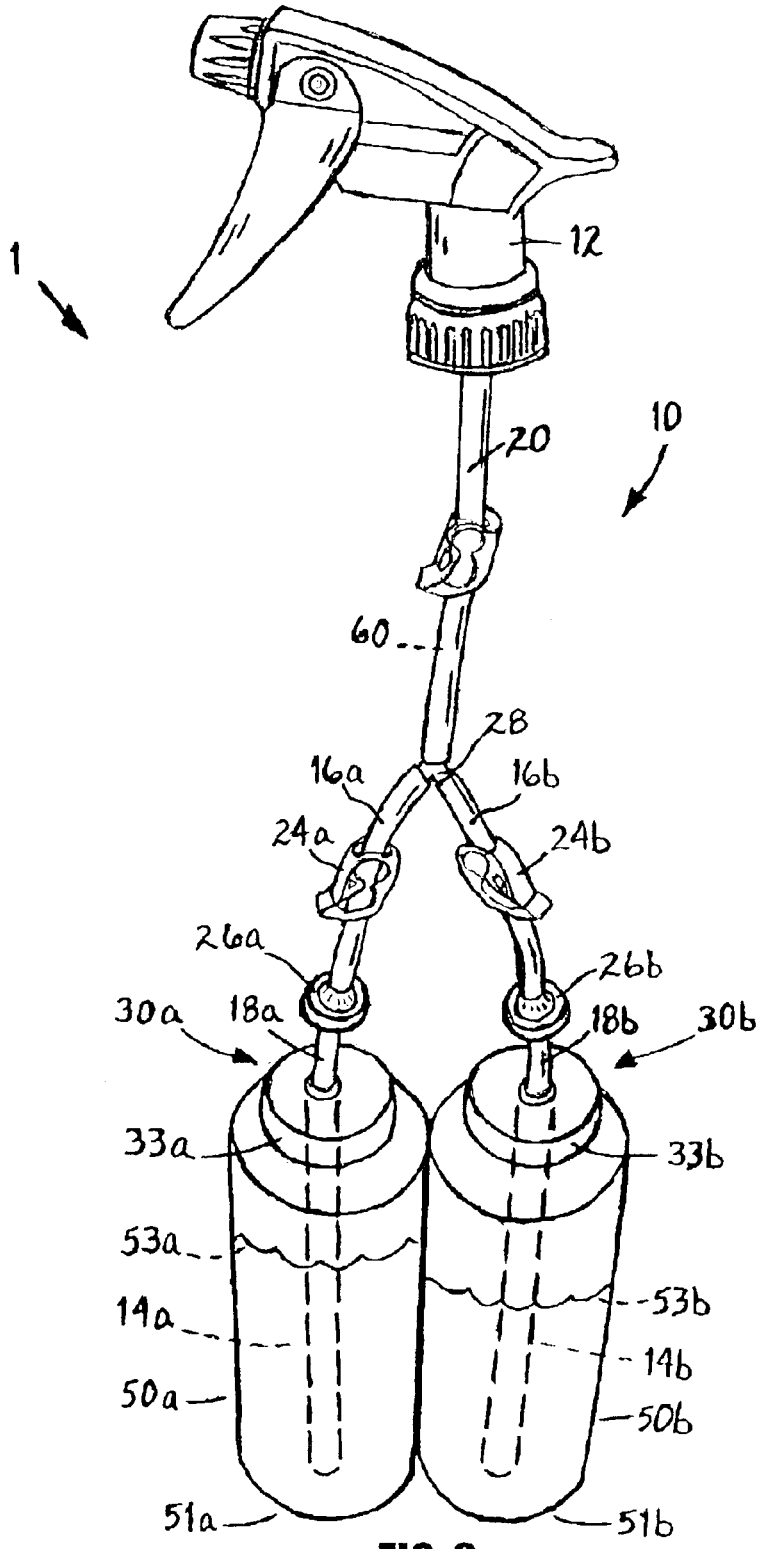
FIG. 2 is a perspective view of the closed system dispensing device.
Figures 3, 4, 5:
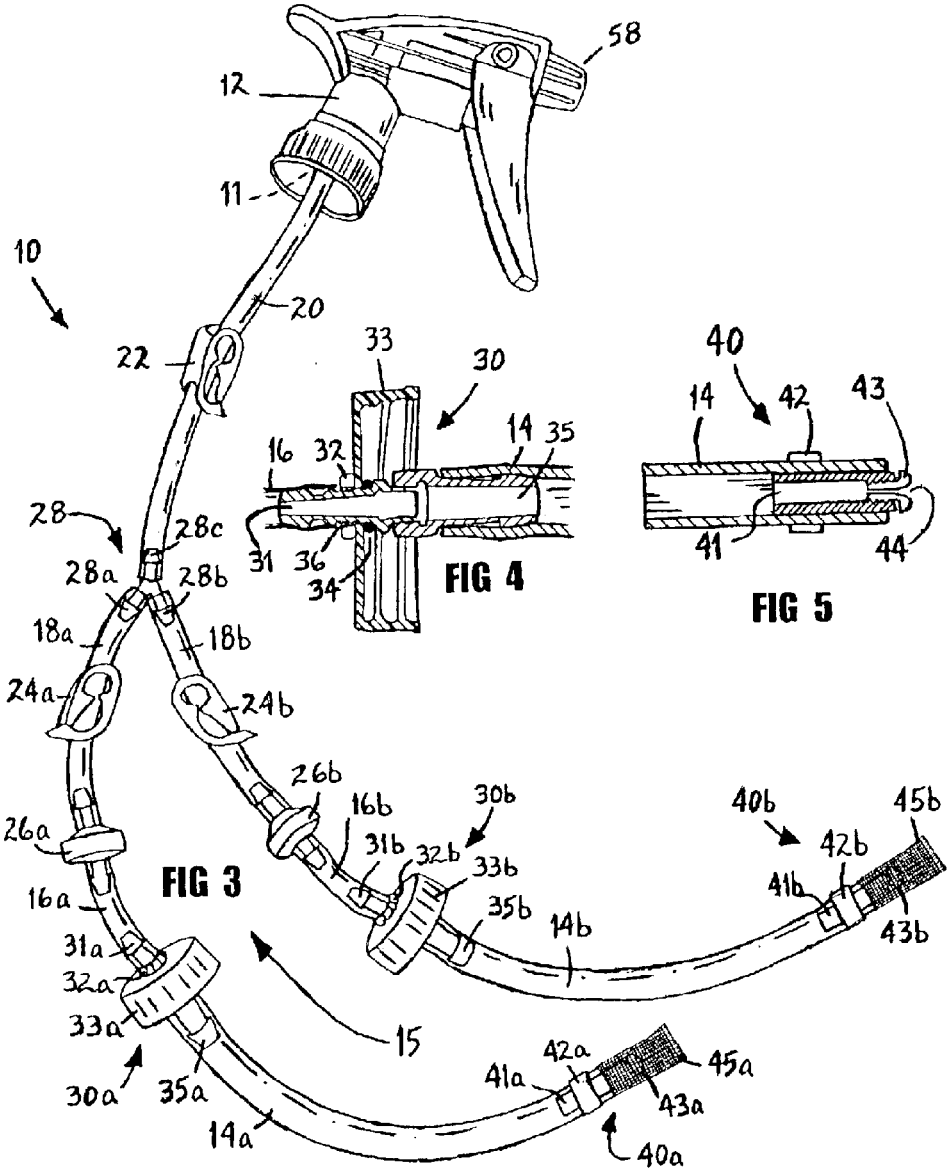
FIG. 3 is a perspective view of Multi-arm tubing assembly
FIG. 4 is a cross-sectional view of panel mount fitting assembly
FIG. 5 is a cross-sectional view of the metering tip assembly

Referring to FIGS. 1, 2 & 3 in further detail, closed system dispensing device 1 comprises flexible elongate flow channels 14*a,b*, 16*a,b*, and 18*a,b* which provide passage for separate fluids 53*a,b* flowing in the direction of arrow 15 from supply containers 50*a,b* to manifold 28. Closed system dispensing device 1 also comprises flexible elongate flow channel 20 which provides passage of the mixture 60 from manifold 28 to pumping means 12. The mixture 60 is expelled through nozzle 58 of to target surface 62.

Flow channels 14*a,b* of FIGS. 2 & 3 are equivalent to those known in the art as 'dip tubes'. They extend from the supply container bases 51*a,b* to the caps 33*a,b* of each supply containers 50*a,b* and provide passage for the two separate fluids 53*a,b* flowing in the direction of arrow 15. Either or both flow channels 14*a,b* also include metering tip assemblies 40*a,b*.

Metering tip assemblies 40*a,b* as shown in FIGS. 2, 3 & 5 comprise threaded inserts 41*a,b* insert clamps 42*a,b*, metering tips 43*a,b* and strainers 45*a,b*. Threaded inserts 41*a,b* are rigid elongate tubular chemically resistant bodies with smooth outer walls and threaded inner linings to mate metering tip 43 threads. Threaded inserts 41*a,b* have outer diameters ("OD") sized to those of the inner diameter ("ID") of flow channels 14*a,b* and lengths typically of about 1 inch each. The inserts 41*a,b* are slid into the end of each flow channel 14*a,b* nearest the supply container bases 51*a,b* and fixedly secured by insert clamps 42*a,b*. Insert clamps 42*a,b* are sized to that of the OD of the flow channels 14*a,b* and positioned over the flow channel 14*a,b* where they squeeze down on the inserts 41*a,b* at points furthest inside the flow channel 14*a,b* thus draw is restricted to the central bore of the threaded insert 41*a,b*. Preferred insert clamps 42*a,b* are the Oetiker clamp, available through most commercial hose suppliers. With the threaded inserts 41*a,b* firmly in place, it is now possible to precisely set the dilution ratio using a metering tip 43, a component known in the art. Suitable color-coded metering tips 43*a,b* covering a broad range of orifice 44 diameters are available from DEMA Corporation, (St. Louis, Mo.). Proportioning of fluids 53*a,b* is accomplished by varying one or both of the user specified metering tips 43*a,b* thus varying the orifice 44 diameters to that needed to achieve the desired dilution ratio of the two fluids to be mixed. Strainers 45*a,b* are used to filter the fluids 53*a,b* of debris so as not to clog metering tip orifice 44. Custom strainers 45*a,b* are available from (CFI Custom Filtration Inc Corcoran, Minn.).

In the preferred embodiment, flow channels 16*a,b* and 18*a,b* provide passage for the two separate fluids 53*a,b* flowing in the direction of arrow 15 from the cap 33*a,b* areas of each supply container 50*a,b* to the manifold 28. Flow channels 16*a,b* extend from the respective panel mount fitting assemblies 30*a,b* as described below, to the inlet barbed ends of one-way check valves 26*a,b*. Check valves 26*a,b* prevent backflow of fluid into respective supply containers 50*a,b*. Flow channels 18*a,b* extend from the outlet barbed ends of respective check valves 26*a,b* to the inlet ends of manifold 28. Flow switches 24*a,b* in the form of tube clamps are installed along the length of flow channel 18*a,b*, preferably nearer the manifold 28 inlet ends. Suitable tube clamps are available from Professional Plastics (Kent, Wash.).

Manifold 28 in the form of a simple three-way barbed fitting comprises two inlet ports 28*a,b* and an outlet port 28*c*. Manifold 28 receives fluids 53*a,b* from flow channels 18*a,b* flowing in direction of arrow 15 then delivers the mixture 60 to flow channel 20.

Flow channel 20 extends from outlet port 28*c* to pump inlet 11 of pumping means 12 and provides passage for the fluid mixture 60 formed in manifold 28 to the pumping means 12. The OD of flow channel 20 is sized to the ID of pump inlet 11. Flow control switches 22, and 24*a,b* in the form of tubing pinch clamps, act to turn the flow on and off through flow channels 20, and 18*a,b* respectively.

Panel mount fitting assemblies 30*a,b* as shown in FIGS. 2 & 4 comprise male leur fitting 31*a,b* and female leur fitting 35*a,b* which have mating leur-type fittings on one of their ends and barbed-type fittings on their other ends, locking nut 32*a,b*, and o-ring 34. Male leur fittings 31*a,b* have male threads 36 about their exterior surface positioned between their leured and barbed ends which mate with a locking nuts 32*a,b*. To assemble the panel mount fitting assemblies 30*a,b*, holes sized to that of the diameter of male leur fittings 31*a,b* are drilled in each cap 33*a,b*. An o-ring 34 also sized to that of the diameter of male leur fitting 31*a,b* is slid onto each male leur fitting 31*a,b* just past its male threads 36. Then, each male leur fitting 31*a,b* is pressed through holes in caps 33*a,b* such that the threads 36 and barbed end extend beyond the outside wall of the caps 33*a,b* and the leured ends of male leur fittings 31*a,b* project inwardly. The threaded lock nuts 32*a,b* are then threaded onto mating threads of male leur fitting 31*a,b* which draws the o-ring 34 to the inner wall surface of caps 33 thus creating a leak proof seal through caps 33*a,b*. To complete the assembly, appropriately sized flow channels 14*a,b* and 16*a,b* are slid onto barbed ends of respective female leur fitting 35*a,b* and male leur fitting 31*a,b* then male leur fitting 31*a,b* and female leur fitting 35*a,b* are releasably connected at their mating leur threads. Panel mount fitting assemblies 30*a,b* may be obtained from Value Plastics (Fort Collins, Colo.). These fittings were chosen because they are inexpensive, constructed of high precision chemically resistant materials, come in variable sizes to mate various sized tubings, and have color coded locking nuts 32*a,b* which help distinguish the arms of the multi-arm tubing assembly 10.

With the panel mount fitting assemblies 30*a,b* in place and the caps 33*a,b* tightly secured to supply containers 50*a,b*, a one-way fluid passageway is thus created which extends from supply container bases 51*a,b* to pumping means 12. By actuating pumping means 12, a predictable and evenly distributed suction force is created on multi-arm tubing assembly 10 such that separate fluids 53*a,b* rise into flow channels 14*a,b* flowing in the direction of arrow 15, then pass through flow channels 16*a,b*, and 18*a,b*, where fluid mixing takes place at manifold 28. The mixture 60 then continues on, passing through flow channel 20 to the pumping means 12 where it is expelled through nozzle 58 and where it is dispensed onto the target surface 62. In the process, each supply container 50*a,b* contracts in size by an amount equal to the volume of fluid withdrawn. When either supply container 50*a,b* empties, the system loses vacuum and fluids 53*a,b* automatically stop flowing.

FIG. 1 shows closed system dispensing device 1 being used to mist a target surface 62. The user is easily able to maintain supply containers 50*a,b* in a near vertical posture while simultaneously misting the mixture 60 onto a horizontal target surface 62. Dispenser pouch 64 provides a watertight reservoir for holding supply containers 50*a,b*, the attached pumping means 12 in the preferred case a trigger sprayer, and a repressurizing device (not shown) as discussed below. Container restrainer 66 is a simple elastic cord fixedly secured to either side of dispenser pouch 64. Container restrainer 66 acts to hold supply containers 50*a,b* inside and toward the rear portion of dispenser pouch 64 so that front portion may be used to store pump means 12 and repressurizing device.

Flow channels 14*a,b*, 16*a,b*, 18*a,b*, and 20 are preferably kept at modest lengths of a foot each or less, so as to minimize time and effort spent priming and dispensing of fluids 53*a,b* to target surface 62. A total of about a foot of separation between panel mount fitting assemblies 30*a,b* and pumping means 12 provides ample reach for treating horizontal surfaces while maintaining the supply containers

50*a,b* in a relatively vertical position. Flow channel 20 will preferably be no longer than a foot or two since its main purpose is to provide fluid communication from the manifold 28 to the pumping means 12, yet it may be lengthened to suit the needs of the user. Flow channels 18*a,b* may be lengthened from their connection at male leur fittings 31*a,b* of the panel mount fitting assemblies 30*a,b* thus extending the user's reach to areas removed from the supply containers 50*a,b*. This may be advantageous for a user a who prefers to leave the supply containers 50*a,b* stationary and dispense in a circumference around them.

Flow channels 14*a,b*, 16*a,b*, 18*a,b*, and 20 may be of various sizes and compatibilities to suit the needs of the user.

To visually distinguish flow channels, user may select among colored flow channels 14*a,b*, 16*a,b*, 18*a,b*, and 20, color-coded locking nuts 32*a,b* or simple tag labels. Obviously, the supply containers 50*a,b* themselves could be labeled as well with labels or color-coded rubber bands stretched around the necks of the various supply containers 50*a,b*.

Flow channels 14*a,b*, 16*a,b*, 18*a,b*, and 20 could be further subdivided by installing in-line couplers along their lengths. These couplers (not shown) could be ideally positioned in-line along the length of multi-arm tubing assembly 10 so that user could easily switch among various supply containers 50*a,b* or even various pumping means. Suitable couplers with barbed fittings are available from US Plastics (Lima, Ohio).

Flow switches 22 and 24*a,b* are squeeze type tube clamps that serve several purposes. They may be used to:

1. close off fluid communication between supply containers 50*a,b* and pumping means 12 when closed system dispensing device 1 is not in use. Flow switch 22 in particular, can be used to prevent shooting whereby user simply closes flow switch 22 in between uses, then actuates (squeezes) pumping means 12 to discharge any fluid remaining in flow channel 20 between flow switch 22 and nozzle 58.
2. close off fluid communication between one or more of the supply containers 50*a,b* and pumping means 12 in the case where only one of the fluids 53*a,b* is to be dispensed.
3. take pressure off the check valves 26*a,b* while closed system dispensing device 1 is not being used, thus extending the life of check valves 26*a,b* and provide back-up to the check valves 26*a,b* in case they should malfunction.

Dual purpose proportioners & on-off control valves could be used in place of the preferred flow switches 22 and 24*a,b*. Squeeze-type tube clamps similar to the one shown in the preferred embodiment could be used but with serrations designed to close off tubing in small increments as it is squeezed are available from Halkey Roberts Corp (St. Petersburg, Fla.). Another type is a screw type pinch clamp type with graduations to mark various dilution ratios. It is available from US Plastics, (Lima, Ohio). Flow switch 22 may be the preferred tube clamps or alternately, the on-off valve of a spray wand.

Flow switches 22 and 24*a,b* may be positioned anywhere along the lengths of flow channels 20 and 18*a,b* respectively to suit the needs of the user. Preferably, flow switch 22 is positioned within a few inches of the pumping means 12 so it is within easy reach of the user. Preferably, flow switches 24*a,b* are positioned near the manifold 28 so as to be in close proximity of user. Flow switches 22 and 24*a,b* may even be omitted at the risk of losing control of flow of the fluids 53*a,b* passing through the multi-arm tubing assembly 10.

Check valves 26*a,b* act to prevent backwards flow of fluid or air into the supply containers 50*a,b* and like the flow switches 22 and 24*a,b*, check valves 26*a,b* may be positioned at various points along the length of multi-arm tubing assembly 10. The user would preferably keep the check valves 26*a,b* positioned within close proximity of the pumping means 12 so as to minimize the volume of fluid uptake required to maintain flow channels 14*a,b* and 16*a,b* in a primed state. Ark-Plas Corp (Flippin, Ark.) produces a variety of barbed and threaded check valves that could serve this purpose. They also manufacture integrated panel mount check valves, but these have the disadvantage of being more expensive, fixedly secured at the caps (thus requiring tedious re-priming before each use), and if either the fitting or the check valve failed, replacement would be required.

Panel mount fitting assemblies 30*a,b* include any of a group of multi-component fittings also known as through-hull fittings or bulk-head fittings. They are all designed to create a leak proof passageway through a flat walled surface. Many different types of fittings could be used in place of the preferred plastic panel mount fitting assemblies 30*a,b*, Brass 'bulkhead fittings' are especially durable but less chemically resistant than those made of various plastics. Such fittings are available from Fittings Inc (Seattle, Wash.).

Supply containers 50*a,b* can be of variable sizes, chemical compatibilities and spatial arrangements as chosen by the user.

Supply containers 50*a,b* are preferably flexible-walled HDPE plastic bottles able to withstand repeated contracting from the suction of pumping means 12. Standard 16 ounce bottles work well for small volume applications such as removing stains from carpet. Such containers are available from wholesale bottle suppliers like RYCO Packaging (Kent, Wash.). Durable rubber washers (not shown) are preferably installed as liners inside each cap 33*a,b* so as to provide a durable seal between caps 33*ab* and supply containers 50*a,b*. Supply containers 50*a,b* are preferably housed in dispenser pouch 64, a convenient place to store the paired containers side by side.

A repressurizing device is useful with closed system dispensing device 1 in three ways:

1. it can be used to restore shape to collapsed supply containers 50*a,b* before refilling them,
2. it can also be used to repressurize partially emptied stock containers (not shown), and thus maintain the potency of any unstable fluids 53*a,b* contained within,
3. it can be used to repressurize partially emptied supply containers 50*a,b* and thus maintain the potency of any unstable fluids 53*a,b* contained within.

The preferred repressurizing device for these purposes is the Fizz Keeper RTM. (Jokari). It is available in two thread sizes to mate various commercially available containers. The 2 liter model is ideal for use with both the preferred 16 ounce containers and the larger 32 ounce containers, and both are available it) the 28–410 cap size. The larger 3 liter model is ideal for repressurizing larger half gallon or one gallon containers. When the 16 ounce containers need refilling, the user simply removes supply container caps 33*a,b* and secures the Fizz Keeper to mating threads of each supply container 50*a,b* and pumps its handle about 30 times to repressurize empty containers and restore them to nearly their original shape. The Fizz Keeper device is then removed and supply containers 50*a,b* are refilled with fluids 53*a,b* and the caps 33*a,b* are tightly re-secured to close the dispensing device 1 to outside air. The Fizz Keeper can be stored in pouch 64 or may used to repressurize the stock containers. To do this, the Fizz Keeper is simply threaded onto stock container and its handle is pumped so as to create pressure inside stock container over the fluid. In this way, the potency of unstable fluids in partially emptied stock containers can be maintained indefinitely. If so desired, the Fizz Keeper can also be used to repressurize the supply containers 50*a,b* in between uses, especially when they won't be used for a day or more. But just by just keeping system closed, less air is exposed to unstable fluids within supply containers 50*a,b* as compared to prior art capped two-part oxidant products or multi-compartment trigger sprayers both of which repeatedly expose unstable fluids to outside air.

Before storage, it is preferable to swap the caps 33*a,b* with the Fizz Keeper and pumping it to create pressure over the fluid 53*a,b* because under ambient conditions, unstable fluids like hydrogen peroxide will expel gases in the closed container. Not only will they lose potency, but pressure will build over fluid inside container which will create a pressure differential between the two supply containers 50*a,b* and distort the dilution ratio during dispensing. If this pressure builds, and the cap 33*a,b* was not swapped with the Fizz Keeper, the user has no choice but to loosen cap and relieve the pressure. Some potency will be lost, but no more than would have been lost with either the two-part oxidant in paired capped containers or the multi-compartment vented trigger dispensers. For any users who use the closed system dispensing device 1 every day, a vacuum is typically developed over the fluids 53*a,b* in supply containers 50*a,b* and the Fizz Keeper need not be used, but for storage (more than about 24 hours in between uses) users would be well advised top swap the cap 33*a,b* with the Fizz Keeper so potency loss could be minimized.

Closed system dispensing device 1 is designed to accept a variety of single source pumping means 12. If it has sufficient suction power to draw both fluids 53*a,b* simultaneously from supply containers 50*a,b* and has an inlet port 11 which communicates with flow channel 20 of multi-arm tubing assembly 10, it may serve as pumping means 12. The user thus has the option to choose from a variety of single pumping means including but not limited to various trigger sprayers, pump dispensers, electric pumps, and siphoning injectors.

Trigger sprayers are well known in the art. All those tested proved suitable for use with the closed system dispensing device 1 of the present invention. The TOLCO (Toledo, Ohio) line of triggers, namely the 320 series was chosen as ideal for they are ergonomic, durable, inexpensive, and available in two chemical compatibilities. The 320 also draws a larger volume (1.3 cc) per squeeze than most standard triggers. Extension handle 68 of FIG. 1 has threads that mate threads of various trigger sprayers and is used to extend the grippable area during squeezing.

Pouch 64 conceals collapsed supply containers 50*a,b*. It also contains drips and provides a convenient place to store pumping means 12 and repressurizing device, Fizz Keeper RTM. (Jokari).

From a review of FIGS. 1 through 5, the assembly of closed system dispensing device 1 from a kit will be apparent.

The main components of closed system dispensing device 1 comprising user defined:

1. multi-arm tubing assembly 10, further comprising flow channels 14*a,b*, 16*a,b*, 18*a,b*, and 20, manifold 28, panel mount fitting assemblies 30*a,b*, flow switches 22 and 24*a,b*, check valves 26*a,b*, quick couplers, and metering tips assemblies 40*a,b* all in customizable dimensions, colors and chemical compatibilities,
2. plurality of supply containers 50*a,b*, in various styles, capacities, and chemical compatibilities,
3. pumping means 12, in various forms, outputs, and chemical compatibilities,
4. optional accessories including dispenser pouch 64, and repressurizing device Fizz Keeper RTM. (Jokari), stock storage containers for various fluids, spotting brushes, and soft white terry cloth towels (none shown) are prepackaged together or separately into a kit form such that any or all of the components and assemblies thereof, as well as any related optional accessories are arranged and compartmented and lay in the package ready for assembly.

Experiments

It could be argued that the closed system dispensing device 1 of the present invention could introduce certain problems as discussed below.

The vacuum created on the system might hinder performance of pumping means 12, namely a trigger sprayer. Experiment 1 below was performed to see how vacuum affected pumping means 12, the dilution ratio could be effected as vacuum builds up inside supply containers 50*a,b*

Experiment 2 below was performed to see if fluid proportioning varied as the supply containers emptied, and the collapsed supply containers 50*a,b* are ugly.

Addressing the collapsed container issue first—this is easily solved by enclosing the supply containers 50*a,b* in the pouch 64. Even though the supply containers 50*a,b* are truly deformed during collapse, the preferred repressurization device, Fizz Keeper RTM (Jokari) quickly restores them to nearly their original shape and capacity at the time of refilling.

Experiment 1: Does Vacuum hinder the performance of trigger sprayers?

Four tests were performed using closed system dispensing device 1 to determine if pumping means 12 draws fluid mixtures 60 from sealed supply containers 50*a,b* at the same rate as from open supply containers 53*a,b*.

Parameters: Each test was performed using the same multi-arm tubing assembly 10. Supply containers 50*a,b* were a pair of standard 16 oz HDPE plastic containers as described in the preferred embodiment. The fluids 53*a,b* used were water.

Two popular pumping means 12 were used in the tests:

1. TOLCO's model 320CR trigger was used for tests 1 and 3, and
2. INDESCO's model 922 trigger was used for tests 2 and 4.

TABLE 1

| | TOLCO's 320CR | INDESCO's 922 |
|---|---|---|
| No vacuum, (caps ajar) | Test 1, 205 ml | Test 2, 175 ml |
| With vacuum, (caps tightly closed) | Test 3, 195 ml | Test 4, 169 ml |
| Loss of volume | 5% | 3% |

Tests 1 and 2 in Table 1 determined the output (volume of mixture produced) of two different pumping means 12, being the trigger sprayers mentioned above, under ambient 'open system' conditions. The multi-arm tubing assembly 10 was assembled as shown in FIG. 1 and the flow channel 20 was connected to pump inlet 11 of pumping means 12. Each of the flow channels 14*a,b* were inserted into supply containers 50*a,b* and the mating caps 33*a,b* were left ajar. No metering tips 43 were installed. Each trigger sprayer was primed then squeezed 200 times and the output was measured and tabulated in Table 1.

Tests 3 and 4 determined the output of each pumping means 12 under vacuum 'closed system' conditions. Each test 3 and 4 was setup like the above tests 1 and 2 respectively, except that the caps 33*a,b* were tightly secured to mating threads of supply containers 50*a,b* before squirting began and the 200 squirt samples were taken as the fluids 53*a,b* in the supply containers 50*a,b* were nearing empty and quite collapsed. Each trigger was again primed then squeezed 200 times and the output was measured and tabulated in Table 1.

Results of Vacuum Tests: Both trigger sprayers performed similarly under vacuum (closed) and ambient (open) conditions. In tests 3 and 4, the supply containers 50*a,b* were almost totally collapsed, yet they produced roughly the same volume as if there were no vacuum on the supply containers 50*a,b*. The bottom line of Table 1 shows that the output is only slightly less (3–5%) with the closed system as compared to the open system. So, it has been shown that trigger sprayers are only slightly hindered in their emptying of supply containers 50*a,b* completely of their fluid contents when under vacuum.

Experiment 2: Does Vacuum affect dilution ratio?

Two tests were performed using closed system dispensing device 1 to determine if pumping means 12 proportions fluids 53*a,b* from sealed supply containers 50*a,b* in the same ratio as from open supply containers 53*a,b*.

Parameters: Each test was performed using the same multi-arm tubing assembly 10. The pump means 12 used for both tests was TOLCO's 320CR. Supply containers 50*a,b* were a pair of standard 16 oz HDPE plastic containers as described in the preferred embodiment. The fluids 53*a,b* used were water.

TABLE 2

| | Test 1, Open | Test 2, Closed |
|---|---|---|
| Part A | 113 ml used | 116 ml used |
| Part B | 102 ml used | 106 ml used |
| Ratio A:B | 1.11:1 | 1.09:1 |

Test 1 in Table 2 determined the dilution ratio under ambient 'open system' conditions. The multi-arm tubing assembly 10 was assembled as shown in FIG. 1 ard the flow channel 20 was connected to pump inlet 11 of pumping means 12. Each of the flow channels 14*a,b* of multi-arm tubing assembly 10 were inserted into supply containers 50*a,b* and the mating caps 33*a,b* were left ajar. No metering tips 43 were installed. The TOLCO trigger sprayer was primed then squeezed 200 times. Remaining volumes of each supply container 50*a,b* were subtracted from the original volumes and the volumes used were tabulated in Table 2 and the ratio of the two fluids used was calculated.

Test 2 determined the dilution ratio under vacuum or 'closed system' conditions. Ate same multi-arm tubing assembly 10 of test 1 was used except that the caps 33*a,b* were tightly secured to mating threads of supply jars 50*a,b* before squirting began and the 200 squirt sample was taken as the fluids in the supply containers 50*a,b* were nearing empty and quite collapsed. Actually, the supply containers 50*a,b* were partially filled with water (250 ml) and then physically squeezed to the point where the fluid level of each supply container 50*a,b* was near its neck and then the caps 33*a,b* were secured. This way, the before and after volume determinations could be more readily determined. The TOLCO trigger sprayer was again primed and squeezed 200 times. The comparatively larger volume for each Part 'used' in Test 2 relative to Test 1 reflects the small volume spent priming the multi-arm tubing assembly 10 before beginning the 200 squirt test. Remaining volumes of each supply container 50*a,b* were subtracted from the starting volumes (250 ml) and the volumes 'used' were tabulated in Table 2 and the ratio of the two fluids was calculated. Results of Proportion tests: the proportion of part A to part B was very similar for both open and closed systems. The bottom line of Table 1 shows that there is only a small difference in the dilution 'ratio.' This difference had probably as much to do with experimental error as the effect of vacuum on the system. It was observed that as long as the relative volume of fluid to air was about the same in both supply containers 50*a,b* at the start of test, the ratio remained consistently the same. So, it has been shown that the pumping means 12 of the preferred closed system dispensing device 1, generates a balanced suction force through the multi-arm tubing assembly 10. So, at least for water thin fluids, it has been shown that the dilution ratio of Parts A & B will remain reasonably consistent throughout the range of fluid levels.

Operation:

Homeowners achieve better results spotting their carpets and other textile fabrics using the closed system dispensing device 1. It puts the right chemistry at their fingertips when they need it. Consumers are surprised when they learn that they can make their own two-part oxidant themselves from readily available chemicals. They can use standard 3% Hydrogen peroxide H.sub.2 O.sub.2 for Part A and clear non-sudsing ammonia for part B, both readily available chemicals from the local grocery and drug stores. They can set the dilution ratio to 1:1 (no metering tips 43*a,b*). When a spill occurs, they can grab their two-part oxidant closed system dispensing device 1, prime it and mist the spot. The two-part oxidant will solve their toughest organic dye related spill if treated promptly. People have confidence in knowing they are not risking burning their fabrics from over-oxidization like when they used the powdered oxygen cleaners. Closed system dispensing device 1 will let homeowners use other specialty two-part products to help them solve their artificial dye related problems.

Both professional cleaners and homeowners are surprised with the efficiency provided by the closed system dispensing device 1. They can simultaneously mix & dispense two or more fluids automatically. It's flexible neck let's them easily mist horizontal surfaces without losing prime. When their supply containers 50*a,b* are all flat and ugly, they are easily restored to their original shape with just a few pumps of their Fizz Keeper so supply containers 50*a,b* can be reused over and over instead of discarding them. They are pleased to learn that they can use the Fizz Keeper to keep the hydrogen peroxide in their supply containers 50*a,b* and stock containers potent indefinitely.

Workers in various industries will benefit from the kit form of the closed system dispensing device 1 of the present invention.

They can specify the main components of multi-arm tubing assembly 10, supply containers 50*a,b*, pumping means 12 and accessories to suit their needs. And if the device 1 malfunctions, it is easy and inexpensive to replace just the part that needs replacing instead of having to replace the entire device.

CONCLUSION

The preceding specific embodiments are illustrative of the practice of the invention. It is to be understood, however, that other expedients known to those skilled in the art or disclosed herein, may be employed without departing from the spirit of the invention or the scope of the appended claims.

I claim:

1. A fluid dispensing device for storing, transporting, and dispensing multiple fluids comprising a multi-arm flow channel means comprising flexible elongate tubing of predetermined length, check valves, fluid proportioning means, flow switch means, manifold means, wherein said multi-arm flow channel provides passageway for a plurality of fluids flowing from a plurality of separate sealable and re-fillable flexible walled fluid supply containers, each said supply container housing one of a plurality of separate fluids, each said supply container fitted with a threadably sealable cap, each cap further fitted with a panel mount fitting means, each said panel mount fitting means comprising a leak proof passageway for said plurality of fluids to pass through to a single source pumping means of sufficient suction power to draw fluids simultaneously from fluids contained within said plurality of supply containers through said multi-arm fluid flow channel means and through check valves which allows fluid to flow towards said pumping means but not backwards into said supply containers and through a manifold means where fluids are mixed and trough an inlet port of said pumping means which mates said flow channel means, whereby fluid mixture is dispensed trough a nozzle of said pumping means to a target surface.

2. The fluid dispensing device of claim 1 wherein said fluid proportioner means comprises a metering tip assembly installed integrally to said flow channels, wherein said metering tip restrains one or more fluids by a fixed amount so as to achieve a desired dilution ratio.

3. The fluid dispensing device of claim 1 wherein said flow switch means comprise tube clamps that act as switches, opening and closing flow channels as desired by the user.

4. The fluid dispensing device of claim 1 wherein sad manifold means comprises a barbed fitting with multiple inlet ports ad a single outlet port which receives separate fluids from various supply containers and mixes.

5. The multi-arm flow channel means of claim 1 of sufficient length and flexibility to enable user to maintain said supply containers nearly vertical while dispensing said mixture onto a horizontal surface.

6. A fluid dispensing device for storing, transporting, and dispensing multiple fluids comprising a multi-are flow channel means comprising flexible elongate tubing of predetermined length, check valves, and manifold means, wherein said multi-arm flow channel provides passageway for plurality of fluids flowing from a plurality of separate sealable and re-fillable flexible walled fluid supply containers, each said supply container housing one of a set of separate fluids, each said supply container fitted with a threadably scalable cap, each cap further fitted with a panel mount fitting means, each said panel mount fitting comprising a leak proof passageway for said plurality of fluids to pass through to a single source pumping means of sufficient suction power to draw fluids simultaneously from fluid contained within said plurality of supply containers through said multi-arm fluid flow channel means and through check valves which allow fluid to flow towards said pumping means but not backwards into said supply containers and trough a manifold means where fluids are mixed and through an inlet port of said pumping means which mates flow channel means, whereby fluid mixture is dispensed though a nozzle of said pumping means to a target surface.

7. The fluid dispensing device of claim 6 wherein said manifold means comprises a barbed fitting with multiple inlet ports and a single outlet port which receives separate fluids form various supply containers and mixes.

8. The multi-arm flow channel means of claim 6 of sufficient length and flexibility to enable user of device to maintain said supply containers nearly vertical while dispensing said mixture onto a horizontal surface.

* * * * *